US007023763B2

(12) United States Patent
Galli

(10) Patent No.: US 7,023,763 B2
(45) Date of Patent: Apr. 4, 2006

(54) ASSEMBLY AND METHOD FOR ILLUMINATING A WATCH

(76) Inventor: Robert Galli, 8176 Horseshoe Bend La., Las Vegas, NV (US) 89113

( * ) Notice: Subject to any disclaimer, the term of this patent is extended or adjusted under 35 U.S.C. 154(b) by 321 days.

(21) Appl. No.: 10/360,781

(22) Filed: Jul. 23, 2003

(65) Prior Publication Data

US 2005/0018544 A1 Jan. 27, 2005

(51) Int. Cl.
*G04B 19/30* (2006.01)

(52) U.S. Cl. ..... 368/67; 368/227; 368/278

(58) Field of Classification Search ..... 368/10, 368/67, 227, 285, 294, 295, 278
See application file for complete search history.

(56) References Cited

U.S. PATENT DOCUMENTS 4,115,994 A 9/1978 Tomlinson ..... 58/50
4,417,819 A 11/1983 Migeon ..... 368/67
4,972,394 A * 11/1990 DiMarco ..... 368/227
5,548,565 A * 8/1996 Aoyama et al. ..... 368/227
5,604,716 A 2/1997 Cheung ..... 368/67
5,894,456 A * 4/1999 Schneider ..... 368/67
6,185,160 B1 * 2/2001 Tsuda ..... 368/67
6,480,441 B1 * 11/2002 McKay ..... 368/10
6,565,253 B1 * 5/2003 Yang ..... 368/294

* cited by examiner

*Primary Examiner*—Kamand Cuneo
*Assistant Examiner*—Thanh S. Phan
(74) *Attorney, Agent, or Firm*—Barlow, Josephs & Holmes, Ltd.

(57) ABSTRACT

An assembly is provided that allows construction of a watch that includes multifunctional illumination options. The assembly of the present invention provides a means for illuminating the watch face, a high intensity flashlight and a watch locator beacon. The assembly overcomes the drawbacks associated with filament lamps by using LED lamps that provide greater brightness with less power consumption. Further, the present invention relies on a unique feature of LED's, whereby they are only illuminated by DC power at the right polarity to provide a compact assembly that utilized a minimum amount of space.

12 Claims, 6 Drawing Sheets

ASSEMBLY AND METHOD FOR ILLUMINATING A WATCH

BACKGROUND OF THE INVENTION

The present invention relates generally to illumination devices for incorporation into wristwatches. More specifically, this invention relates to a multifunction illumination assembly for incorporation into wristwatches whereby LED lighting elements are provided for use to illuminate the watch face, to act as a watch locator and to serve as a flashlight.

In the prior art, various types of illumination devices have been proposed for wristwatches to enable reading the time under poor light conditions. Primarily, phosphorescent materials have been employed on watch dials with varying degrees of success and all suffering from the well-known shortcoming of being difficult to see particularly with the passage of time as the phosphorescence decreases. Moreover, the phosphorescent material requires recharging by being exposed to light in order for the phosphorescence to be maintained. In addition, the luminous materials used in dials of the foregoing watches also lose their light emitting capacity with age and have generally provided substantially less than fully satisfactory performance.

As an alternative to the use of phosphors, electric devices for watch illumination have been employed with some limited success. Such devices usually take the form of small incandescent bulbs powered by a battery and arranged inside the case of the wristwatch, assisted by light pipes or reflectors to enable the numerals on the dial to be seen. In other assemblies, it has been proposed to carry a small battery outside the watchcase in a special attachment connected to the watchband. In this case, an incandescent bulb is carried in the watch crystal, connected to the battery by lead-in wires, and operated by a switch. Further, the prior art discloses an incandescent bulb carried on the watchcase and connected to a battery in an attachment connected between the watchband and the case by means of lead wires. A deformable or flexible wall allows the circuit to be closed to illuminate the dial by pressing the flexible wall.

In all of the foregoing arrangements, the lead wires passing between the power source in the watchband attachment and the incandescent bulb in the case or crystal are subject to possible malfunction, due to breakage caused by the constant and repetitive movement between the case and the attachment. Also, the arrangements described are not easily utilized as a flashlight if such functionality is desired by the user.

Another shortcoming of many of the prior art devices is that they inefficiently rely upon a relatively powerful illumination source, which attempts to illuminate the entire area of the dial by simple radiation from the source. Often the result causes portions of the dial nearest the light source to become overly illuminated in order that the portions spaced from the light source may have adequate illumination. Additionally, this approach tends to cause shadows especially with curved surfaces and three-dimensional objects. Other drawbacks of the prior known devices for providing dial illumination include the fact that they are bulky and are frequently both delicate and expensive. In general, these devices employing incandescent filament operated bulbs have not been accepted for portable devices due to the fact that they require substantial battery capacity for their operation due to their substantial power requirement.

BRIEF SUMMARY OF THE INVENTION

In accordance with the present invention, an assembly is provides that allows construction of a watch that includes multifunctional illumination options. The assembly of the present invention provides a means for illuminating the watch face, a high intensity flashlight and a watch locator beacon. The assembly overcomes the drawbacks associated with filament lamps by using LED lamps that provide greater brightness with less power consumption. Further, the present invention relies on a unique feature of LED's, whereby they are only illuminated by DC power at the right polarity to provide a compact assembly that utilized a minimum amount of space.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

Figure 1:
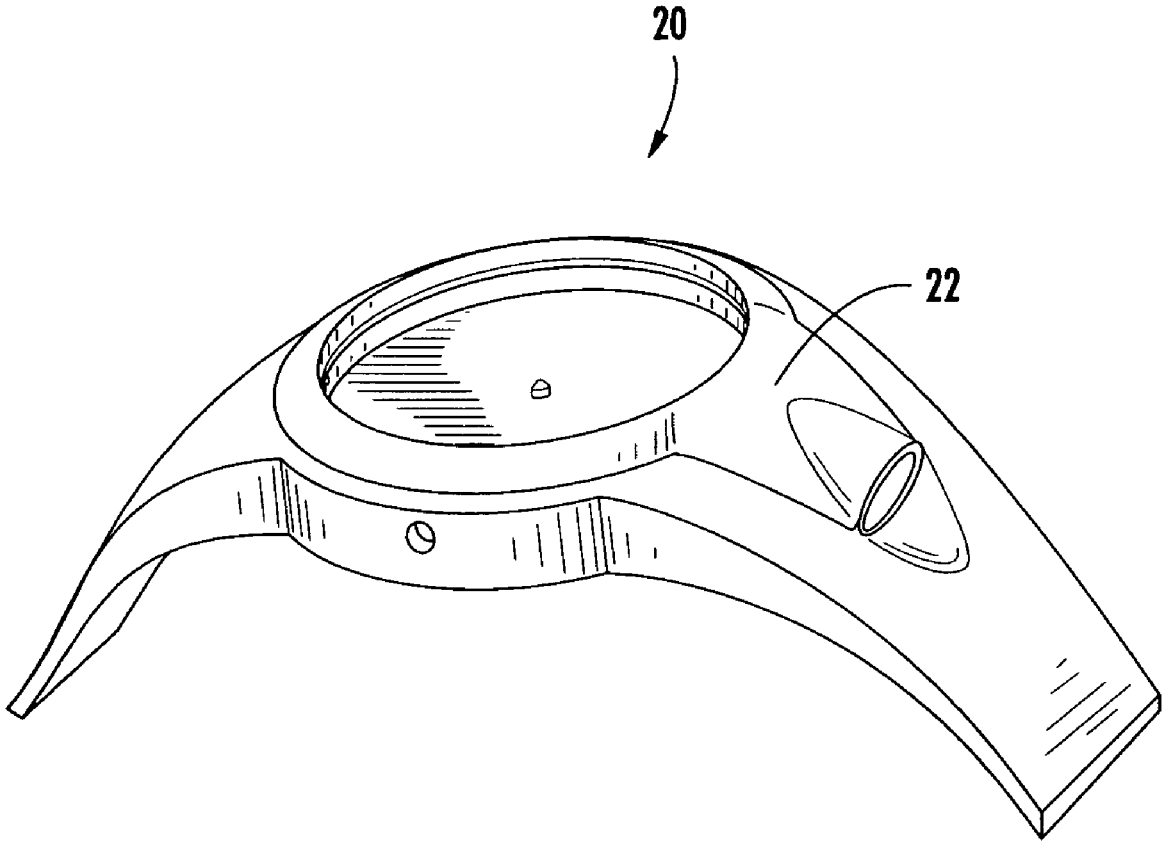
FIG. 1 is a perspective view of the illuminated watch flashlight of the present invention.
Figure 2:
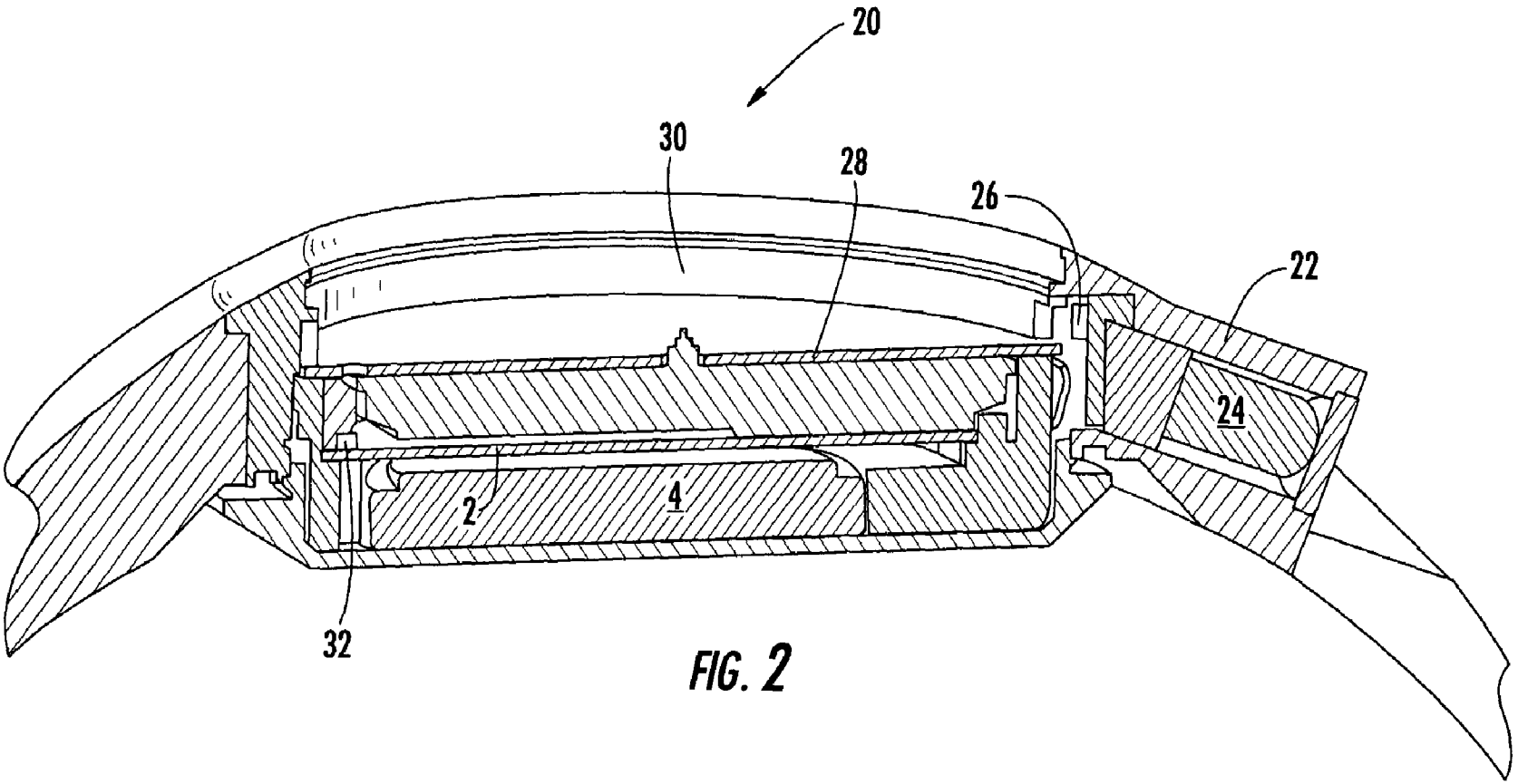
FIG. 2 is a cross-sectional view thereof.
Figure 3:
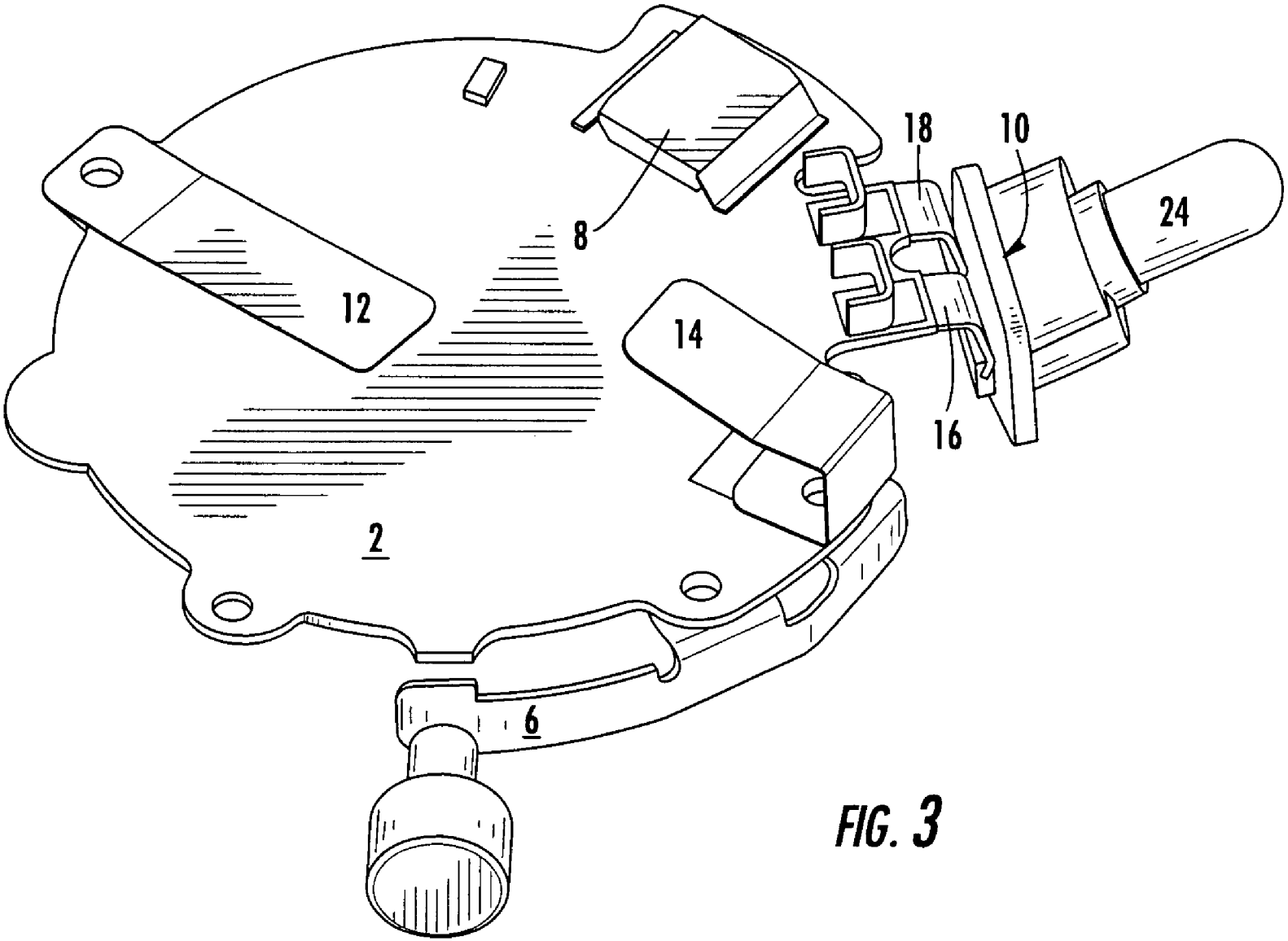
FIG. 3 is a bottom view of the illumination assembly for the illuminated watch of the present invention.
Figure 4:
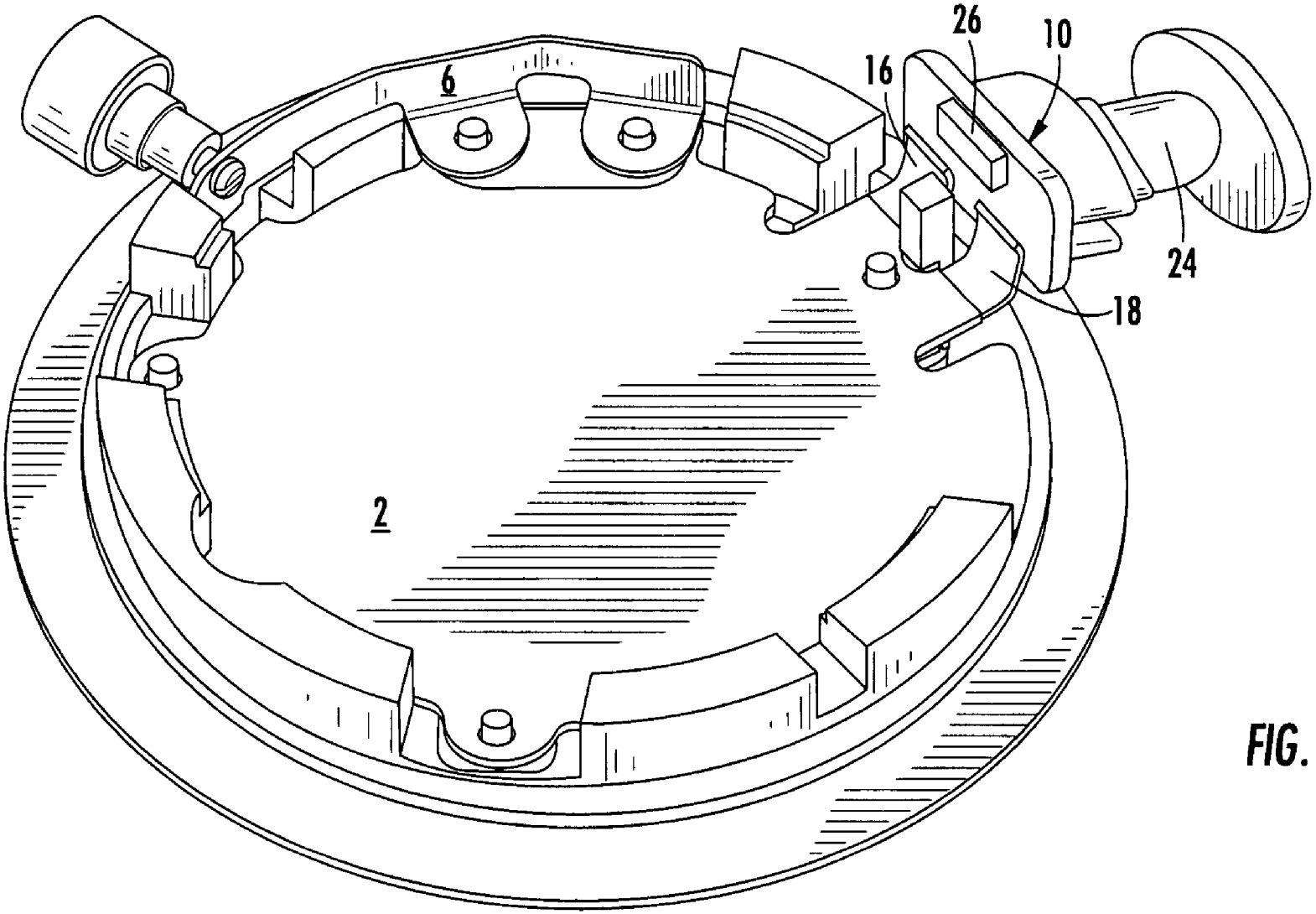
FIG. 4 is a top view of the illumination assembly for the illuminated watch of the present invention.
Figure 5:
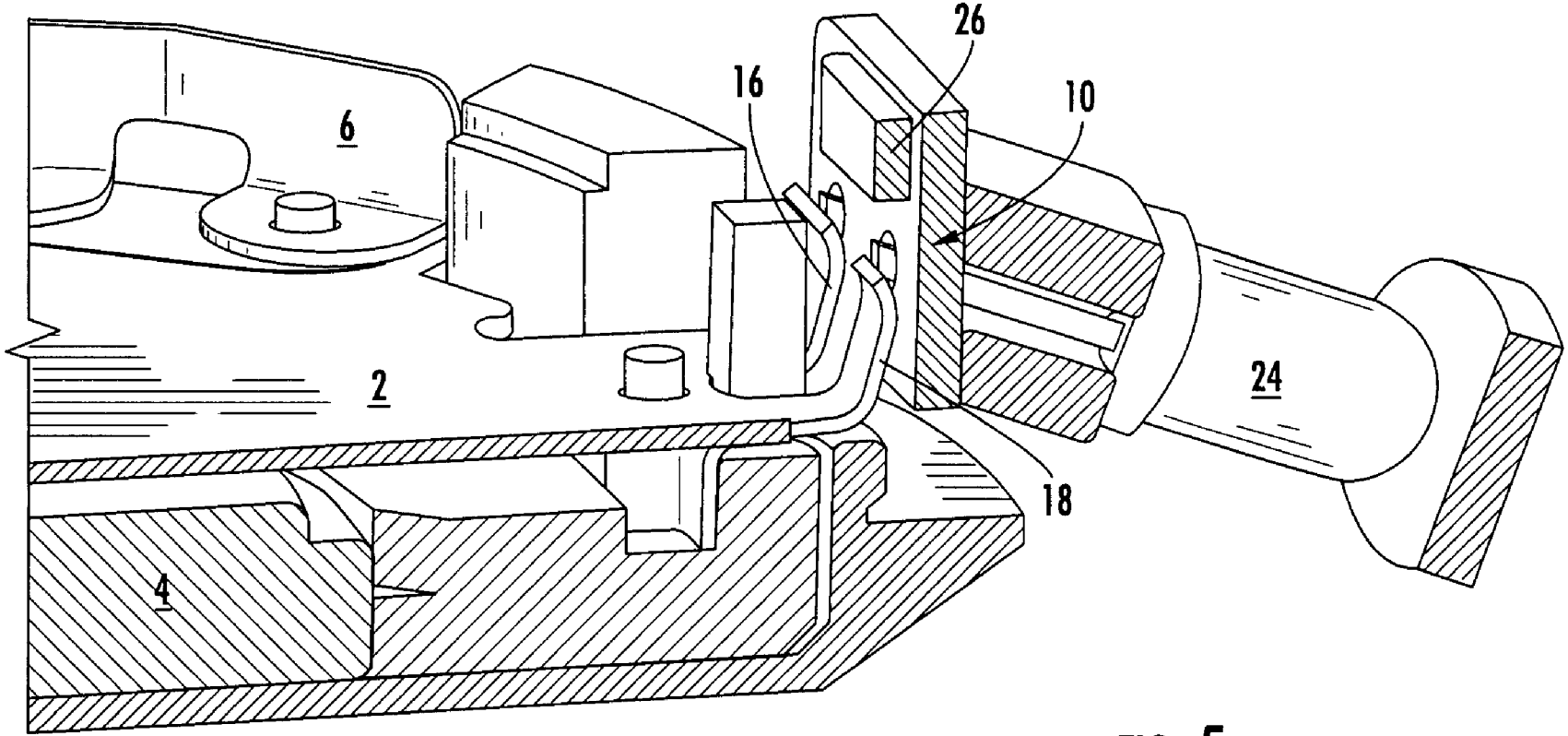
FIG. 5 is a detail view of the interface between the illumination assembly and the LED support member.
Figure 6:
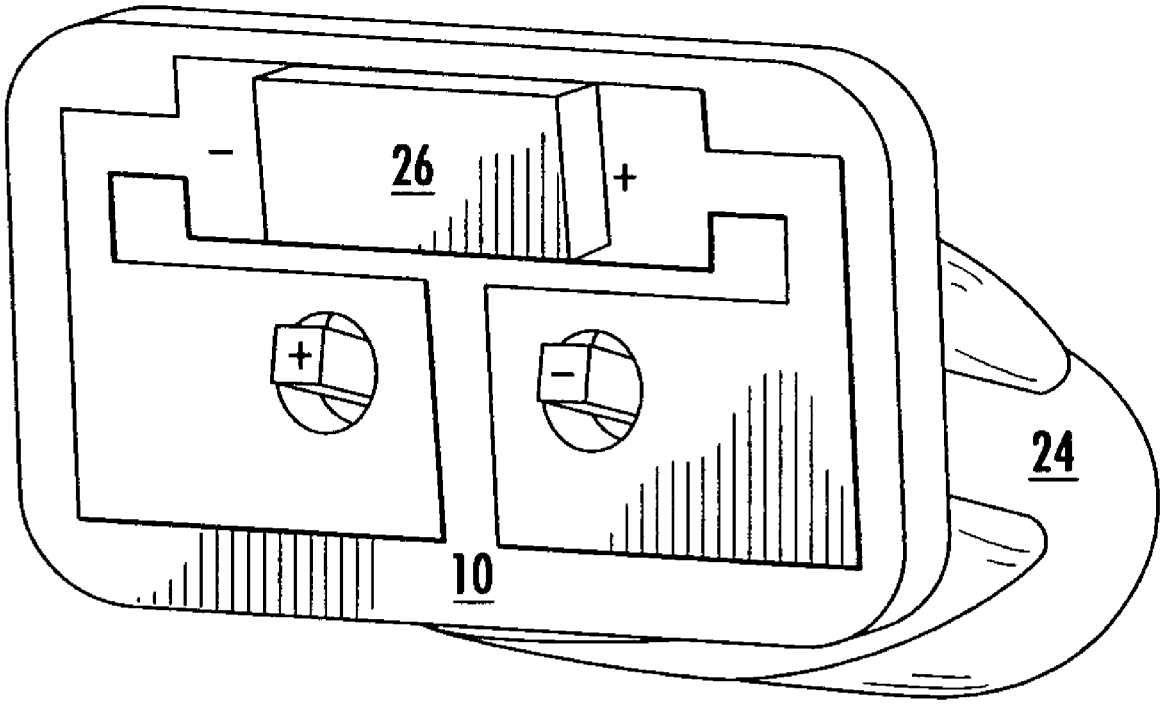
FIG. 6 is a rear view of the LED support member.

Referring now to the drawings, in general, the present invention includes a small circuit board 2 assembly that includes a space to which a battery 4 is mounted, a movable switch actuator 6 and a logic chip 8. Further, a second assembly 10 is provided to support two LED elements that provide the required illumination functions. The primary assembly, seen best in FIGS. 3 and 4, is simply a circuit board 2 with the operative components mounted thereon. The required contact clips 12, 14, 16, 18 to engage the power source 4 as well as the LED support assembly 10 are clearly illustrated, as is the switch 6 in the form of a spring contact. As is best seen in the cross-sectional view of FIG. 2, the entire assembly is configured and sized so as to allow it to be mounted into a conventional type watch assembly 20. While the present invention is shown to rely on a separate battery 4 power source, the present invention also anticipates that the assembly could also get the required power by piggybacking power from the main watch 20 power source.

The LED mounting assembly 10 is configured to be placed in a side mount position in the side of the watch case 22. The mounting assembly 10 has two LED emitters 24, 26 mounted thereon. The first LED emitter 24 is a high brightness LED suitable for use as a flashlight. The LED 24 may be any acceptable color for flashlight use including but not limited to red, white, blue or green. The LED 24 is mounted to the assembly 10 so that the optical element extends through a small opening in the side of the watch case 22 towards the exterior of the watch 20 thereby serving as a flashlight when energized. The second emitter 26 is a flat or surface mount emitter having a small form factor. In the preferred embodiment, the LED 26 is an ultraviolet emitter, although the LED 26 may be any color emitter suitable for illuminating the watch face. The second emitter 26 is placed onto the mounting assembly opposite the first LED 24 and faces in towards the interior of the watch case 22. The second emitter 26 is positioned adjacent to an opening in the wall 22 of the watch case 22 just above the face 28 and beneath the crystal 30. When energized, the emitter floods 26 the face 28 with energy for a short period of time. In the preferred embodiment, the case 22 is flooded with UV energy that energizes the phosphors deposited on the watch face 28 and the operational components such as watch hands to cause the watch 20 to illuminate. The phosphor material is selected to be particularly suited for energization by UV energy to enhance the speed and intensity at which it energizes. While UV is disclosed, this manner of illumination may work equally well with other LED emitter colors and other matched phosphor colors.

Another important feature of the present invention is that the particular property of LED's that causes them only to illuminate when DC current is applied in one direction allows the multifunctional feature of the watch to be achieved in a compact space. The first 24 and second 26 emitters are mounted onto a small board 10 where the positive and negative leads of each are connected in parallel in opposition to one another. In other words, the negative lead of the first LED 24 is connected to the positive lead of the second LED 26 and the positive lead of the first LED 24 is connected to the negative lead of the second LED 26. In this manner, when voltage is applied to the LED assembly 10 with one polarity, the first LED 24 will illuminate, hen the polarity is reversed the second LED 26 will illuminate. This allows the LED support assembly 20 to be connected to the circuit board 2 with only two connection leads 16, 18. The logic chip 8 on the primary circuit board 2 controls the polarity in response to input from the switch 6. For example, if the switch 6 is simply pressed and released, the chip 8 may activate the UV emitter 26 to energize the watch face 28. If the switch 6 is held for more than momentary contact, the chip 8 may activate the high intensity LED 24. In this manner, any range of operational configurations may be obtained.

Finally, the present invention includes a third small LED element 32 that protrudes to the exterior of the watch 20 either in the face 28 of the side of the casing 22. The third LED 32 will blink at a predetermined interval to act as a locator beacon.

Clearly, the present invention is novel in that it exploits the intrinsic operational differences between LED's and traditional filament type lamps. Previously, where package size, durability and power consumption was an issue, LED's can be incorporated to allow the enhanced functionality described herein. In particular, the low energy consumption of the LED's the long lamp life and the small size provides for a durable and compact device that could not be achieved in the prior art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

The invention claimed is:

1. A watch assembly comprising:

a housing, said housing having a side wall, an interior compartment and channel extending through said sidewall from said interior compartment to the exterior of the housing;

a first means for illumination in said interior compartment, wherein light from said first means for illumination is directed through said channel in a first direction to the exterior of the housing;

a timepiece installed in said interior compartment, said timepiece having a face;

a second means for illumination in said interior compartment, wherein light from said second means for illumination is directed through said channel in a second direction, opposite said first direction, and directly falls onto said face of said timepiece;

at least one power source in said interior compartment, said at least one power source providing power for said timepiece, said first means for illumination and said second means for illumination; and a means for selectively and independently energizing said first and second means for illumination.

2. The watch assembly of claim 1, wherein said first and second means for illumination are light emitting diodes.

3. The watch assembly of claim 2, wherein said first light emitting diode has an output color, said color selected from the group consisting of white, red, blue, yellow and combinations thereof.

4. The watch assembly of claim 2, wherein said second light emitting diode has an output color, said color selected from the group consisting of white, red, blue, yellow, ultraviolet and combinations thereof.

5. The watch assembly of claim 2, wherein said first light emitting diode is white and said second light emitting diode is ultraviolet.

6. The watch assembly of claim 1, said at least one power source comprising:

a first power source providing power for said timepiece; and a second power source providing power for said first and second means for illumination.

7. An illumination assembly for a watch, said watch having a housing, said housing having a side wall, an interior compartment, a channel extending through said sidewall from said interior compartment to the exterior of the housing and a timepiece installed in said interior compartment, said timepiece having a face, said illumination assembly comprising:

a first means for illumination in said interior compartment, wherein light from said first means for illumination is directed through said channel in a first direction to the exterior of the housing;

a second means for illumination in said interior compartment, wherein light from said second means for illumination is directed through said channel in a second direction, opposite said first direction, and directly falls onto said face of said timepiece;

at least one power source in said interior compartment, said at least one power source providing power for said timepiece, said first means for illumination and said second means for illumination; and a means for selectively and independently energizing said first and second means for illumination.

8. The illumination assembly for a watch of claim 7, wherein said first and second means for illumination are light emitting diodes.

9. The illumination assembly for a watch of claim 8, wherein said first light emitting diode has an output color, said color selected from the group consisting of white, red, blue, yellow and combinations thereof.

10. The illumination assembly for a watch of claim 8, wherein said second light emitting diode has an output color, said color selected from the group consisting of white, red, blue, yellow, ultraviolet and combinations thereof.

11. The illumination assembly for a watch of claim 8, wherein said first light emitting diode is white and said second light emitting diode is ultraviolet.

12. The illumination assembly for a watch of claim 7, said at least one power source comprising:

a first power source providing power for said timepiece; and a second power source providing power for said first and second means for illumination.

* * * * *